US005274873A

United States Patent [19]

Shields

[11] Patent Number: 5,274,873

[45] Date of Patent: Jan. 4, 1994

[54] ANGULATED BRISTLE TOOTHBRUSH

[76] Inventor: Melvin A. Shields, 2784 Monterey Hwy. #21, San Jose, Calif. 95111-3139

[21] Appl. No.: 872,844

[22] Filed: Apr. 23, 1992

[51] Int. Cl.[5] ..... A46B 5/06

[52] U.S. Cl. ..... 15/167.1; 15/176.5; 15/202; 15/194

[58] Field of Search ..... 15/167.1, 167.2, 194, 15/201, 202, 176.1-176.6, 176/160, 159.1, 184; 300/21

[56] References Cited

U.S. PATENT DOCUMENTS

| | | | |
|---|---|---|---|
| 986,051 | 3/1911 | Funk | 15/184 |
| 1,189,698 | 7/1916 | Keating | 15/184 |
| 1,592,207 | 7/1926 | Havrilla | 15/184 |
| 1,685,328 | 9/1928 | Kogler et al. | 15/202 |
| 2,242,743 | 5/1941 | Brown | 15/167.1 |
| 3,085,273 | 4/1963 | Cowan | 15/167.1 |

FOREIGN PATENT DOCUMENTS

| | | | |
|---|---|---|---|
| 683311 | 6/1930 | France | 15/167.1 |
| 254206 | 12/1948 | France | 15/202 |
| 2624360 | 6/1989 | France | 15/167.1 |
| 78776 | 4/1918 | Switzerland | 15/176.5 |

*Primary Examiner*—Harvey C. Hornsby
*Assistant Examiner*—Gary K. Graham
*Attorney, Agent, or Firm*—Leon Gilden

[57] ABSTRACT

A toothbrush assembly includes a handle having a toothbrush head mounted at a forward distal end of the handle, with the handle head having a head top surface. Plural rows of bristle columns are mounted fixedly to the handle head's top surface, with the bristle rows arranged in varying angulations towards a forward or rear end of the toothbrush head to accommodate access to various portions of an individual's mouth during a toothbrushing procedure.

1 Claim, 4 Drawing Sheets

ANGULATED BRISTLE TOOTHBRUSH

BACKGROUND OF THE INVENTION

1. Field of the Invention

The field of invention relates to toothbrush construction, and more particularly pertains to a new and improved angulated bristle toothbrush wherein the same is arranged with a plurality of toothbrush columns of varying angulations mounted to a top surface of the toothbrush head.

2. Description of the Prior Art

Toothbrush construction of various types have been utilized throughout the prior art to accommodate access to various components of an individual's mouth during a toothbrushing procedure. Such toothbrushes are exemplified in U.S. Pat. No. 4,800,608 to Key wherein the bristle head is formed having a fixed obtuse angle medially of the toothbrush head.

U.S. Pat. No. 4,729,142 to Yoshioka sets forth a toothbrush head having the bristles directed towards a medial center of the toothbrush head.

U.S. Pat. No. 4,852,202 to Ledwitz sets forth a toothbrush head having angulated bristles, wherein the bristles include first bristles having an orthogonal orientation relative to the toothbrush head, with a plurality of secondary bristles mounted at a generally forty-five degree angle relative to the toothbrush head.

Accordingly, it may be appreciated that there continues to be a need for a new and improved angulated bristle toothbrush as set forth by the instant invention which addresses both the problems of ease of use as well as effectiveness in construction arranged with angulated bristles and in this respect, the present invention substantially fulfills this need.

SUMMARY OF THE INVENTION

In view of the foregoing disadvantages inherent in the known types of toothbrush construction now present in the prior art, the present invention provides an angulated bristle toothbrush wherein the same includes a plurality of rows of toothbrush bristle columns arranged at varying angles towards forward and rear end portions of the toothbrush head. As such, the general purpose of the present invention, which will be described subsequently in greater detail, is to provide a new and improved angulated bristle toothbrush which has all the advantages of the prior art toothbrush construction and none of the disadvantages.

To attain this, the present invention includes a toothbrush assembly with a handle having a toothbrush head mounted at a forward distal end of the handle, with the handle head having a head top surface. Plural rows of bristle columns are mounted fixedly to the handle head's top surface, with the bristle rows arranged in varying angulations towards a forward or rear end of the toothbrush head to accommodate access to various portions of an individual's mouth during a toothbrushing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved angulated bristle toothbrush which has all the advantages of the prior art toothbrush construction and none of the disadvantages.

It is another object of the present invention to provide a new and improved angulated bristle toothbrush which may be easily and efficiently manufactured and marketed.

It is a further object of the present invention to provide a new and improved angulated bristle toothbrush which is of a durable and reliable construction.

An even further object of the present invention is to provide a new and improved angulated bristle toothbrush which is susceptible of a low cost of manufacture with regard to both materials and labor, and which accordingly is then susceptible of low prices of sale to the consuming public, thereby making such angulated bristle toothbrushes economically available to the buying public.

Still yet another object of the present invention is to provide a new and improved angulated bristle toothbrush which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
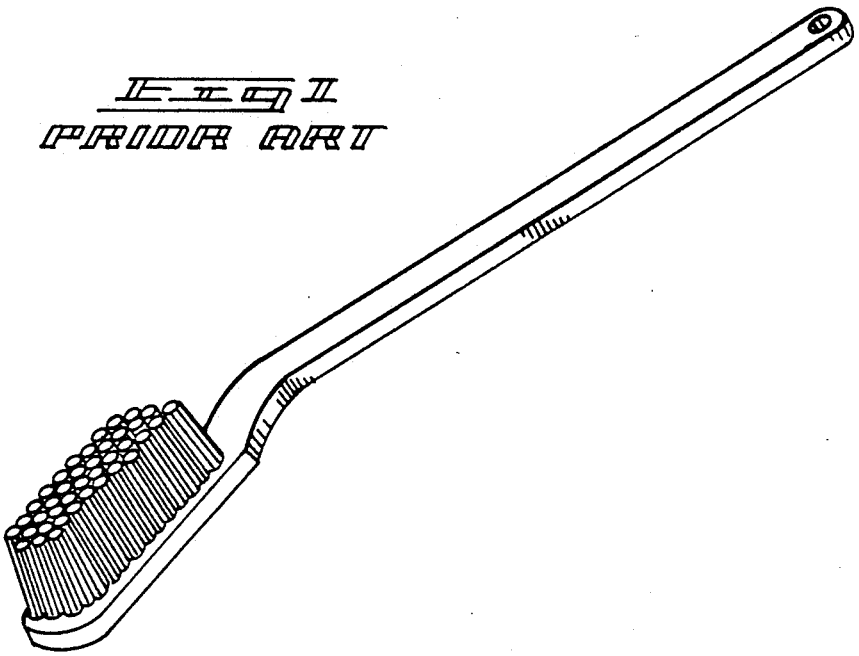
FIG 1 PRIOR ART
FIG. 1 is an isometric illustration of a prior art toothbrush arrangement.
Figure 2:
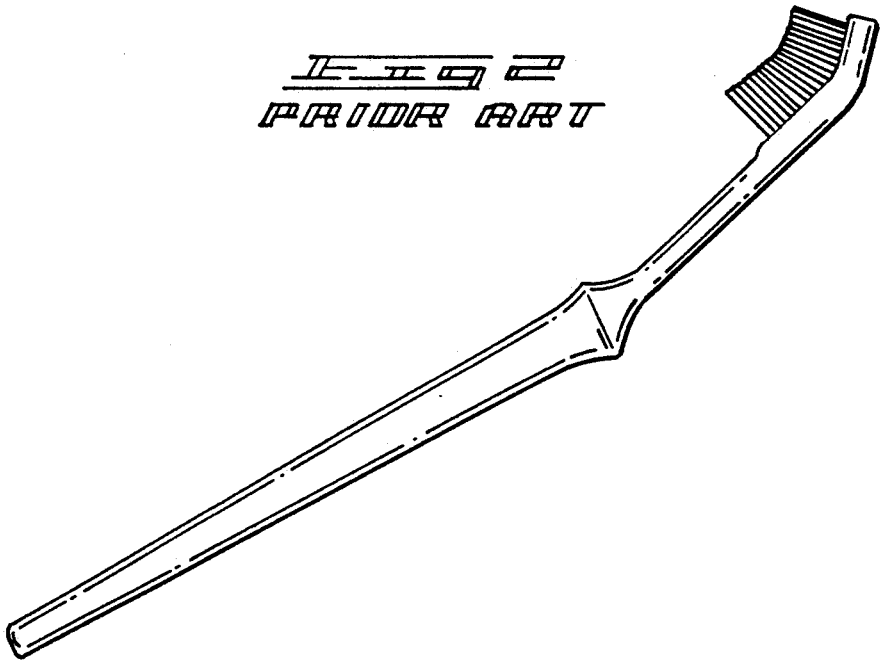
FIG 2 PRIOR ART
FIG. 2 is an orthographic side view of a further example of a toothbrush arrangement.
Figure 3:
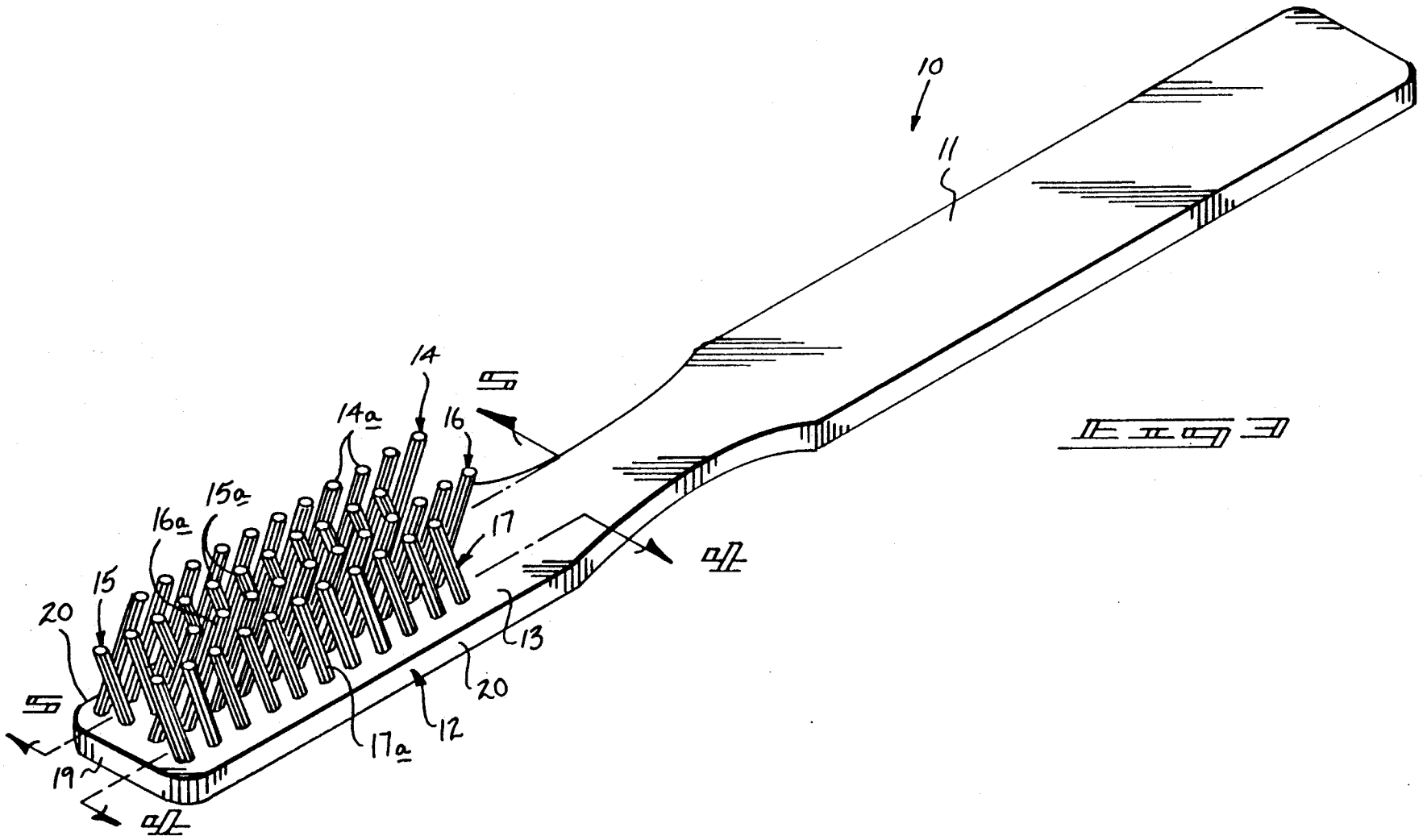
FIG. 3 is an isometric illustration of the instant invention.
Figure 4:
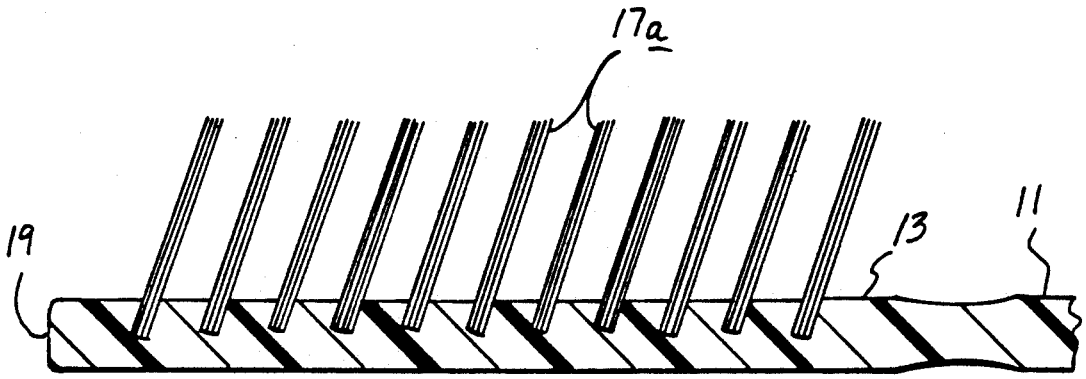
FIG. 4 is an orthographic view, taken along the lines 4—4 of FIG. 3 in the direction indicated by the arrows.
Figure 5:
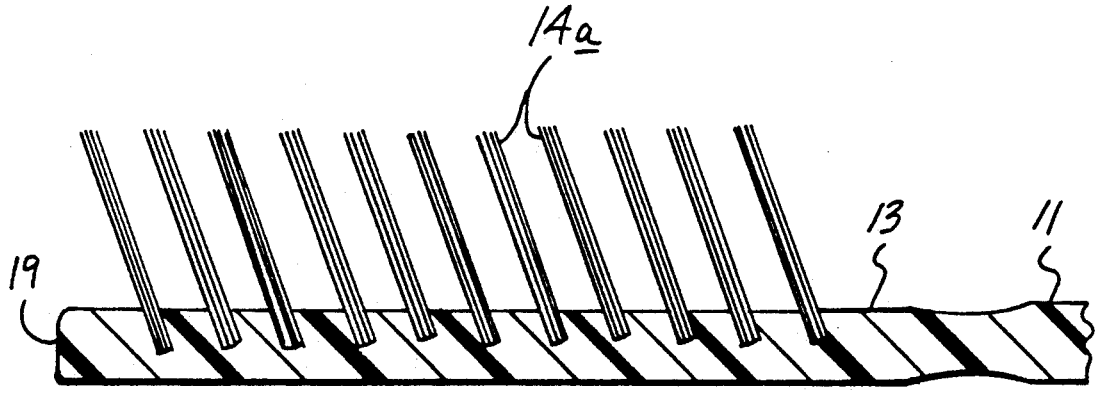
FIG. 5 is an orthographic view, taken along the lines 5—5 of FIG. 3 in the direction indicated by the arrows.

With reference now to the drawings, and in particular to FIGS. 1 to 7 thereof, a new and improved angulated bristle toothbrush embodying the principles and concepts of the present invention and generally designated by the reference numerals 10 and 10*a* will be described.

More specifically, the angulated bristle toothbrush 10 of the instant invention essentially comprises a toothbrush handle 11 having a toothbrush head 12 mounted at a forward distal end of the handle in a longitudinally aligned relationship. The toothbrush head 12 is formed with a head top surface 13 of a generally planar configuration having respective first, second, third, and fourth bristle rows 14, 15, 16, and 17. Respective first, second, third, and fourth bristle clusters 14*a*, 15*a*, 16*a*, and 17*a* respectively are each formed of individual bristles in a tubular configuration defining each of the rows. The rows are arranged in a parallel relationship relative to one another and are orthogonally oriented relative to the toothbrush head's forward end 19, as well as parallel relative to the toothbrush sides 20. The bristle clusters are each arranged at an acute included angle relative to a perpendicular reference the top surface 12 and are arranged at substantially fifteen to twenty-five degrees. Adjacent rows are of alternating inclination relative to one another. More specifically, the first bristle row 14 is angulated to define an obtuse included angle relative to the top surface 12 as viewed from the forward end 19. The third bristle row 16 is of an identical configuration. The second and fourth bristle rows define the acute included angles as viewed from the forward end 19 relative to the top surface 12. In summary, the rows 14 and 16 are canted towards the handle 11, while the second and fourth rows are canted towards the toothbrush head forward end 19.

Figures 6, 7:
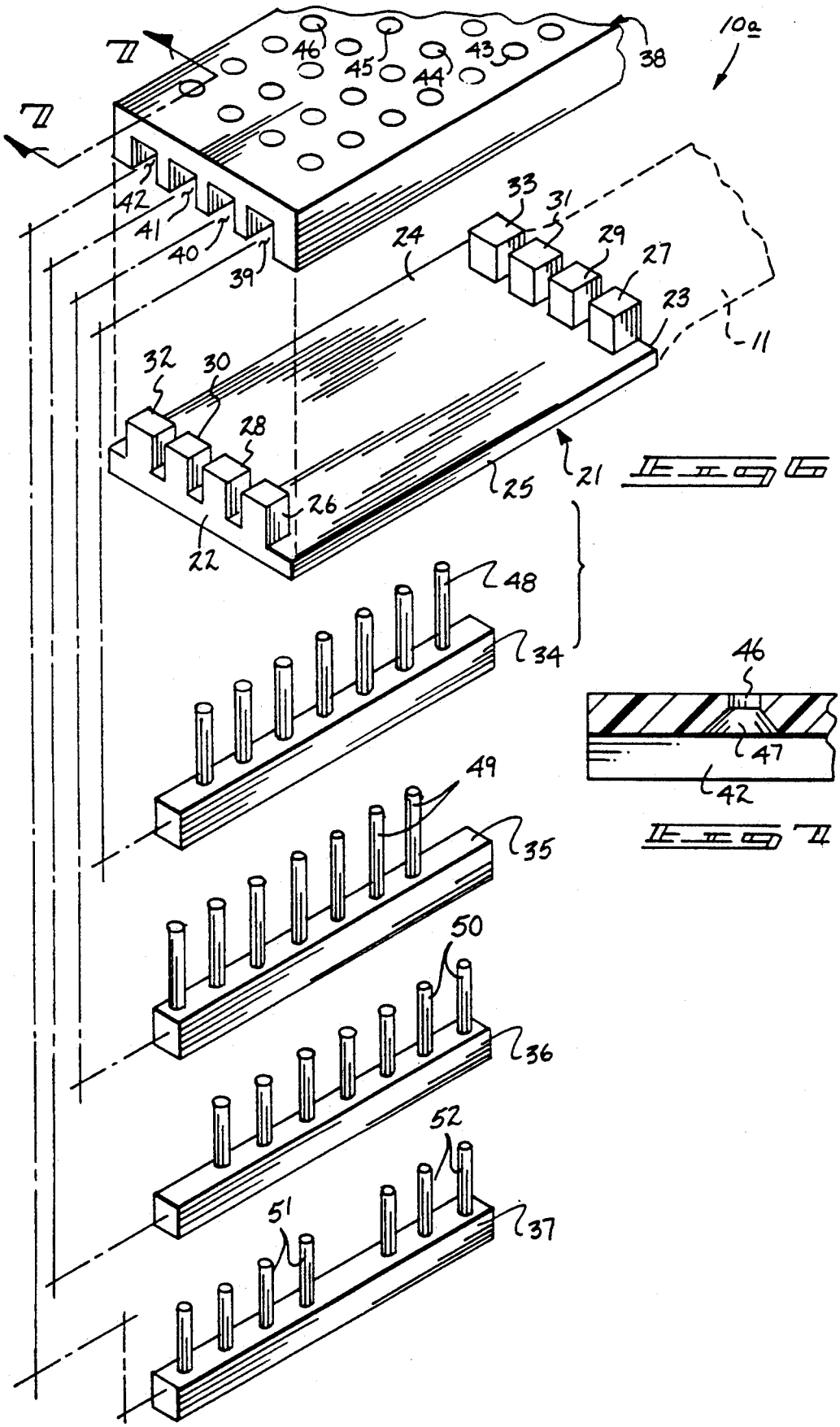
FIG. 6 is an isometric exploded view of a modified toothbrush head portion of the invention.
FIG. 7 is an orthographic view, taken along the lines 7—7 of FIG. 6 in the direction indicated by the arrows.

The toothbrush arrangement 10*a*, as illustrated in the FIG. 6, sets forth an organization permitting adjustable inclination of the first through fourth rows. To this end, a head plate 21 is provided having a head plate forward end 22 spaced from and parallel a head plate rearward end 23. Head plate first and second sides 24 and 25 respectively are orthogonally oriented relative to the forward and rearward ends 2 and 23 on opposed sides of the head plate 21. Abutment blocks are provided between the first and second sides 24 and 25 mounted to the respective top surface of the head plate 21 adjacent the respective forward and rearward ends 22 and 23. A first forward and rear block 26 and 27 is provided in equally spaced relationship relative to the second side 25. Second forward and rear blocks 28 and 29 positioned adjacent the first forward and rear blocks 26 and 27 are equally spaced therefrom. Third forward and rear blocks 30 and 31 are positioned adjacent the second forward and rear blocks 28 and 29 equally spaced therefrom, and similarly, fourth forward and rear blocks 32 and 33 are positioned adjacent the third forward and rear blocks 30 and 31, with the fourth blocks positioned adjacent the first side 24. It should be noted that each set of blocks defined by the first blocks 26 and 27, the second blocks 28 and 29, the third blocks 30 and 31, and the fourth blocks 32 and 33 are equally spaced apart relative to one another a predetermined length, e.g. a predetermined length is defined between the first forward and rear blocks 26, 27, the second forward and rear blocks 28, 29, etc. between the forward and rearward ends 22 and 23. In this manner, positioned between each set of blocks is a mounting link defined by first, second, third, and fourth mounting links 34, 35, 36, and 37 that are positioned between the respective first, second, third, and fourth set of blocks. Accordingly, the mounting links are each of a length equal to the predetermined length.

Upon positioning of each mounting link between a respective set of the blocks, e.g. the first mounting link 34 between the first set of blocks 26 and 27, an alignment head 38 is arranged for reception over the head plate 21. The alignment head 38 includes a plurality of parallel channels 39, 40, 41, and 42 defining respective first, second, third, and fourth channels. Each respective channel receives a respective mounting link therewithin. The first channel 39 includes a set of first channel bores 43 directed through the alignment head 38 in communication with the first channel 39. Second channel bores 44 are directed through the alignment head 38 into the second channel 40, and similarly, respective third and fourth channel bores 45 and 46 are directed through the alignment head 38 into communication with the respective third and fourth channels 41 and 42. The bores within each of the channels are spaced apart an equal spacing, and each of the channel bores includes a bore conical entrance 47 in communication with the respective channel, in a manner as illustrated in FIG. 7. In this manner, the first mounting link 34 has first block bristle columns 48 mounted fixedly thereon that each bristle column 48 is coaxially aligned with a respective first channel bore 43. A second column of second block bristle columns 49 fixedly mounted to the second mounting link 45 are axially displaced relative to the second channel bores 44 towards the head plate forward end 22. Third block bristle columns 50 are axially displaced relative to the third channel bores 45 towards the rearward end 23. The fourth mounting link 37 includes fourth block first and second bristle columns 51 and 52, with the fourth block first bristle columns 51 axially displaced relative to the fourth channel bores 46 towards the forward end 22, with the fourth block bristle second columns 52 axially displaced relative to the fourth channel bores 46 towards the head plate rearward end 23. In this manner, a splayed angulation of the various bristle columns are available to accommodate projection of the bristle columns towards various crevices and surfaces of an individual's mouth to reach various components therewithin. It should be noted that in the axially displaced bristle column of the mounting links 35, 36, and 37, the acute included angle defined when the bristle columns are directed through an associated channel bore is within a range of the fifteen to twenty-five degrees as noted above as an effective angulation to accommodate reaching various components of an individual's mouth in a toothbrushing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An angulated bristle toothbrush, comprising, an elongate toothbrush handle, the toothbrush handle having an elongated toothbrush head mounted at a forward end of the handle, with the toothbrush handle and toothbrush head in a longitudinally aligned orientation relative to one another, the toothbrush head including a toothbrush head forward end, and a first bristle row of first bristle clusters, a second bristle row of second bristle clusters, a third bristle row of third bristle clusters, and a fourth bristle row of fourth bristle clusters, each of said rows extending from the head, wherein a plurality of the bristle clusters are inclined at an acute included angle relative to the bristle head and are canted towards the toothbrush head forward end, and the first bristle clusters of the first bristle row are canted towards the toothbrush handle, the second bristle clusters of the second bristle row are canted towards the toothbrush forward end, the third bristle clusters of the third bristle row are canted towards the toothbrush handle, and the fourth bristle clusters of the fourth bristle row are canted towards the toothbrush head forward end, wherein each bristle cluster of each bristle row defines an acute angle between fifteen and twenty-five degrees relative to a top surface of the toothbrush head, and the toothbrush head is formed as a head plate, the head plate including a head plate forward end coincident with the toothbrush head forward end, and a head plate rearward end at an intersection of the toothbrush handle relative to the head plate, and a head plate first side spaced from a head plate second side, and a first block set including a first forward block mounted adjacent the head plate forward end, and a first rear block mounted adjacent the head plate rearward end, the first forward block and the first rear block positioned adjacent and in equally spaced relationship relative to the head plate second side, a second forward block and a second rear block mounted to the head plate adjacent the first forward block and the first rear block in equally spaced relationship, and a third forward block and a third rear block mounted to the head plate adjacent the second forward block and the second rear block, and a fourth forward block and a fourth rear block mounted to the head plate adjacent the third forward block and the third rear block and adjacent the head plate first side, with the first forward block and the first rear block spaced apart a predetermined length, the second forward block and the second rear block spaced apart the predetermined length, the third forward block and the third rear block spaced apart the predetermined length, and fourth forward block and the fourth rear block spaced apart the predetermined length, and a first mounting link having the first bristle clusters mounted thereon, a second mounting link having the second bristle clusters mounted thereon, a third mounting link having the third bristle clusters mounted thereon, and a fourth mounting link having the fourth bristle clusters mounted thereon, the first mounting link positioned between the first forward block and the first rear block, the second mounting link positioned between the second forward block and the second rear block, the third mounting link positioned between the third forward block and the third rear block, and the fourth mounting link positioned between the fourth forward block and the fourth rear block, and an alignment head receiving the bristle clusters therethrough, the alignment head including a first channel receiving the first mounting link, a second channel receiving the second mounting link, a third channel receiving the third mounting link, and a fourth channel receiving the fourth mounting link.

* * * * *